US006769880B1

(12) United States Patent
Hogan et al.

(10) Patent No.: US 6,769,880 B1
(45) Date of Patent: Aug. 3, 2004

(54) PRESSURE BLOWDOWN SYSTEM FOR OIL INJECTED ROTARY SCREW AIR COMPRESSOR

(75) Inventors: James Victor Hogan, Nanaimo (CA); Alan Michael Augustynek, Nanaimo (CA)

(73) Assignee: Mangonel Corporation, Nanaimo (CA)

( * ) Notice: Subject to any disclaimer, the term of this patent is extended or adjusted under 35 U.S.C. 154(b) by 119 days.

(21) Appl. No.: 10/246,446

(22) Filed: Sep. 19, 2002

(51) Int. Cl.[7] ..... F04B 49/24
(52) U.S. Cl. ..... 417/299; 417/310; 137/115.16
(58) Field of Search ..... 137/115.16; 417/299, 417/307, 310, 440

(56) References Cited

U.S. PATENT DOCUMENTS

| | | | | | |
|---|---|---|---|---|---|
| 2,442,361 | A | * | 6/1948 | Hulman | 417/299 |
| 2,469,362 | A | * | 5/1949 | Bashark | 417/299 |
| 2,536,486 | A | * | 1/1951 | Berry | 417/299 |
| 2,661,017 | A | | 12/1953 | Geiger | |
| 2,890,714 | A | | 6/1959 | Greenwood | |
| 3,211,174 | A | | 10/1965 | Weise et al. | |
| 3,294,111 | A | | 12/1966 | Abercrombie et al. | |
| 3,373,763 | A | | 3/1968 | Smilges et al. | |
| 3,399,689 | A | | 9/1968 | Keane | |
| 3,406,712 | A | | 10/1968 | Weise | |
| 3,414,008 | A | | 12/1968 | Greenwood | |
| 3,568,706 | A | | 3/1971 | Weise | |
| 3,664,362 | A | | 5/1972 | Weise | |
| 3,961,862 | A | | 6/1976 | Edstrom et al. | |
| 4,355,657 | A | | 10/1982 | Reip | |
| 4,384,590 | A | | 5/1983 | Friend | |
| 4,390,041 | A | | 6/1983 | Reip | |
| 4,544,333 | A | * | 10/1985 | Hirano | 417/299 |
| 4,566,863 | A | * | 1/1986 | Goto et al. | 417/310 |
| 5,050,635 | A | | 9/1991 | Tetsuka et al. | |
| 5,156,177 | A | * | 10/1992 | Bishoff | 417/299 |
| 5,639,225 | A | * | 6/1997 | Matsuda et al. | 417/310 |
| 5,715,864 | A | | 2/1998 | Andel et al. | |
| 5,769,113 | A | | 6/1998 | Alberts et al. | |
| 5,842,501 | A | | 12/1998 | Powell et al. | |
| 6,026,587 | A | | 2/2000 | Cunkelman et al. | |
| 6,123,515 | A | | 9/2000 | Santoro, Jr. et al. | |
| 6,161,570 | A | | 12/2000 | McNeely | |
| 6,283,716 | B1 | | 9/2001 | Centers | |
| 6,289,919 | B1 | | 9/2001 | Sledd et al. | |
| 6,318,406 | B1 | | 11/2001 | Conley | |

* cited by examiner

*Primary Examiner*—Michael Koczo
(74) *Attorney, Agent, or Firm*—Antony C. Edwards

(57) ABSTRACT

A pressure blowdown system for an oil-injected rotary screw air compressor having an output conduit mounted to a high pressure side of the compressor and having a feedback conduit mounted to an intake side of the compressor, includes a rigid container having a gas reservoir therein, the container having a rigid plate mounted thereon closing the reservoir, a rigid valve housing mounted to the plate, the housing defining a valve spool cavity and having a pressure blowdown vent, the cavity having first and second opposite ends, a valve spool slidably snugly mounted in the cavity for sliding translation between the first and second ends of the cavity, respectively into first and second positions in the cavity. Resilient means are mounted in the cavity for resiliently urging the valve spool from the first end towards the second end of the cavity. A first gas passageway in the plate provides unobstructed fluid communication between the first end of the cavity and the feedback conduit of the compressor. A second gas passageway in the plate provides unobstructed fluid communication between the second end of the cavity and the gas reservoir, where the gas reservoir is in unobstructed fluid communication with the output conduit of the compressor.

9 Claims, 5 Drawing Sheets

PRESSURE BLOWDOWN SYSTEM FOR OIL INJECTED ROTARY SCREW AIR COMPRESSOR

FIELD OF THE INVENTION

This invention relates to a rapid blowdown system for a rotary screw air compressor which is integral with an end cap of an air receiver/oil separation tank associated with the compressor, where upon a pressure drop occurring between the suction inlet to the compressor and the air receiver/oil separation tank results in a rapid blowdown of pressure within the air receiver /oil separation tank.

BACKGROUND OF THE INVENTION

In the past, rotary screw air compressor systems have required a means for rapidly reducing the air pressure within the air receiver/oil separator tank when the compressor operation ceases so as to avoid restarting under a pneumatic load. Typically, in the past the preferred method has been to utilize a pneumatically piloted two-way valve. A conduit typically connecting the valve to the compressor provides a zero or slightly negative gauge pressure to the pilot valve during compressor operation allowing the valve to remain in a closed state. At the instant of compressor cessation, the conduit provides full system pressure to the pilot valve forcing the valve to an open state thereby allowing the system pressure within the compressor tank to be vented through the pilot valve. Generally, the pilot valve has been a separate component of the compressor which can be easily damaged.

It is an object of the present invention, where the compressor is a vehicle mounted compressor, generally driven by suitable drive means from the vehicle engine and having an associated air receiver/oil separation tank remotely located therefrom, to provide a blowdown system which is seamlessly integrated with the air receiver tank housing so as to avoid the dangers associated with accidental damage to such a piloted two-way valve or to associated external hoses and connections.

A further object of this invention is to provide an air receiving tank having an end cap incorporating an integral blowdown system including a blowdown valve having a first end in direct fluid communication with a compressed air receiving tank and a second end in indirect communication with a compressed air receiving tank through a high impedance scavenging orifice which optimally restrict both air and oil flow out of the compressor to the second end of the valve.

It is a further object of the present invention to provide direct fluid communication from both the air receiving tank and the second valve end within the air receiving tank of the compressor, for continuous oil replenishment and pressure equalization.

SUMMARY OF THE INVENTION

The present invention is a blowdown system for a rotary screw air compressor, which is integral with an end cap of the air receiving tank. The blowdown system incorporates a generally cylindrical valve housing containing a valve spool. The interior of the valve housing is, at a first end, in fluid communication with an air receiving tank of a compressor through a low impedance first passageway extending from the air receiving tank to the first end of the valve housing. At its second end, the interior of the valve housing is also in fluid communication with the air receiving tank through a second passageway, having a high impedance scavenging orifice at a point of entry to the air receiving tank, the second passageway being in low impedance communication with the air intake or suction line of the compressor. The scavenging orifice provides communication of the interior of the valve housing to the high-pressure end of the compressor. A venting orifice is located at a generally medial point between the first and second ends of the cylindrical valve housing and is selectively closable by sliding a shuttling of the valve spool.

During the operation of the compressor the first passageway, extending from the air receiving tank to the first end of the valve housing, maintains the first end of the valve housing at a system pressure, that is, the air pressure within the air receiving tank and within the interior first end of the valve housing remain identical. The low impedance second passageway provides fluid communication between the second end of the valve housing and the air receiving tank. This second passageway is also in fluid communication with the suction inlet port of the compressor, by way of an air/oil scavenging conduit, which maintains the interior of the second end of the valve housing at a significantly lower pressure, generally near zero or at a slightly negative gauge pressure, that is, a negative pressure relative to local atmospheric pressure. The high impedance scavenging orifice located between the proximal end of the second passageway and the compressed air receiving tank is sized to optimally restrict both air and oil flow out of the air receiving tank. This pressure differential between the first and second end of the valve housing results in the valve being forced toward the second end of the generally cylindrical valve housing during normal compressor operation.

Cessation of compressor operations results in air at system pressure equalizing in both the compressor and the air receiving tank since only minimal loss of pressurized air is possible through the high impedance scavenging orifice. Simultaneously, a mixture of air and oil returns through the air/oil scavenging conduit to the low impedance second passageway and to the interior of the second end of the valve housing. This results in air pressure equalizing at both the first and second ends of the valve housing. A compression spring within the second end of the valve housing then urges the valve spool toward the first end of the valve housing. This action brings the first passageway into communication with a venting aperture to permit rapid decompression of the air receiving tank of the compressor. Suitable annular sealing means adjacent the second end of the valve prevent escapement of compressed air and oil directly from the venting aperture.

In summary, the pressure blowdown system of the present invention for an oil-injected rotary screw air compressor having an output conduit mounted to a high pressure side of the compressor and having a feedback conduit mounted to an intake side of the compressor, includes:

a) a rigid container having a gas reservoir therein, the container having a rigid plate mounted thereon closing the reservoir, b) a rigid valve housing mounted to the plate, the housing defining a valve spool cavity, the cavity having first and second opposite ends, c) a valve spool slidably snugly mounted in the cavity for sliding translation between the first and second ends of the cavity, respectively into first and second positions in the cavity.

Resilient means are mounted in the cavity for resiliently urging the valve spool from the first end towards the second end of the cavity.

A first gas passageway in the plate provides unobstructed fluid communication between the first end of the cavity and the feedback conduit of the compressor. A second gas passageway in the plate provides unobstructed fluid communication between the second end of the cavity and the gas reservoir, where the gas reservoir is in unobstructed fluid communication with the output conduit of the compressor.

The valve housing has an exhaust aperture into the cavity so that the cavity is in fluid communication with ambient atmosphere when the exhaust aperture is not closed by the valve spool. The exhaust aperture is positioned so as to be covered by the spool when the spool is translated into the first the second position in the cavity. The spool has a third gas passageway therethrough in fluid communication from the second end of the cavity to the exhaust aperture when the spool is in the second position. The spool when not in the second position seals the exhaust aperture closed.

A fourth gas passageway may be provided which is in fluid communication between the gas reservoir and the first gas passageway. The fourth gas passageway contains a flow restricting orifice therein restricting fluid flow between the gas reservoir and the first gas passageway.

A second end-exposed face of the spool, which faces the second end of the cavity, includes a spacing protrusion extending therefrom along a shuttle axis of the spool for spacing the second end-exposed face from an end wall of the second end of the cavity when the spool is in the second position. A first end-exposed face of the spool opposite the second end-exposed face may include a bayonet mount mounted thereto and aligned along the shuttle axis. The resilient means may be a helical spring. The plate may be an end cap on the container.

The valve spool and the cavity may be cylindrical and the second gas passageway may include an annular channel formed around the spool. A bore may extend from the second end-exposed face of the spool to the annular channel. The annular channel extends annularly around the shuttle axis of the spool and aligns with the exhaust aperture when the spool is in the second position.

A fifth gas passageway may be provided in the plate in fluid communication between the gas reservoir and a pressure signal line extending between an inlet valve of the compressor and the fifth gas passageway.

The plate may be mounted to the container so as to extend between a bottom of the container adjacent the bottom of the gas reservoir and a top of the container. The second gas passageway may be located adjacent the top of the gas reservoir.

The fourth gas passageway may be located at the bottom of the gas reservoir. The first gas passageway may intersect the fourth gas passageway at the bottom of the gas reservoir and the feedback conduit may be mounted to the first gas passageway at the bottom of the gas reservoir.

DETAILED DESCRIPTION OF EMBODIMENTS OF THE INVENTION

Figure 1:
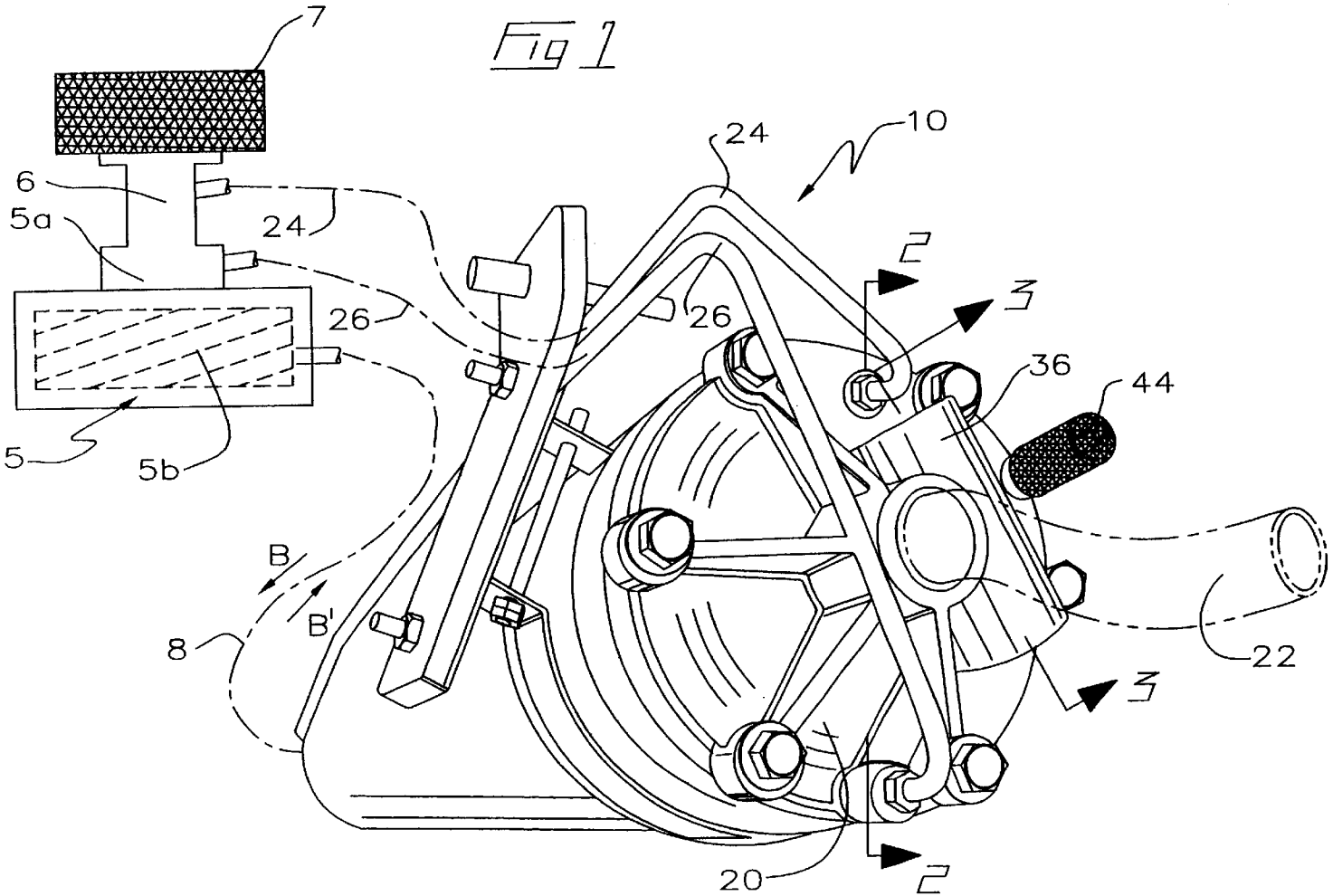
FIG. 1, is a perspective view of the compressor, tank and end cap of the present invention.
Figure 2:
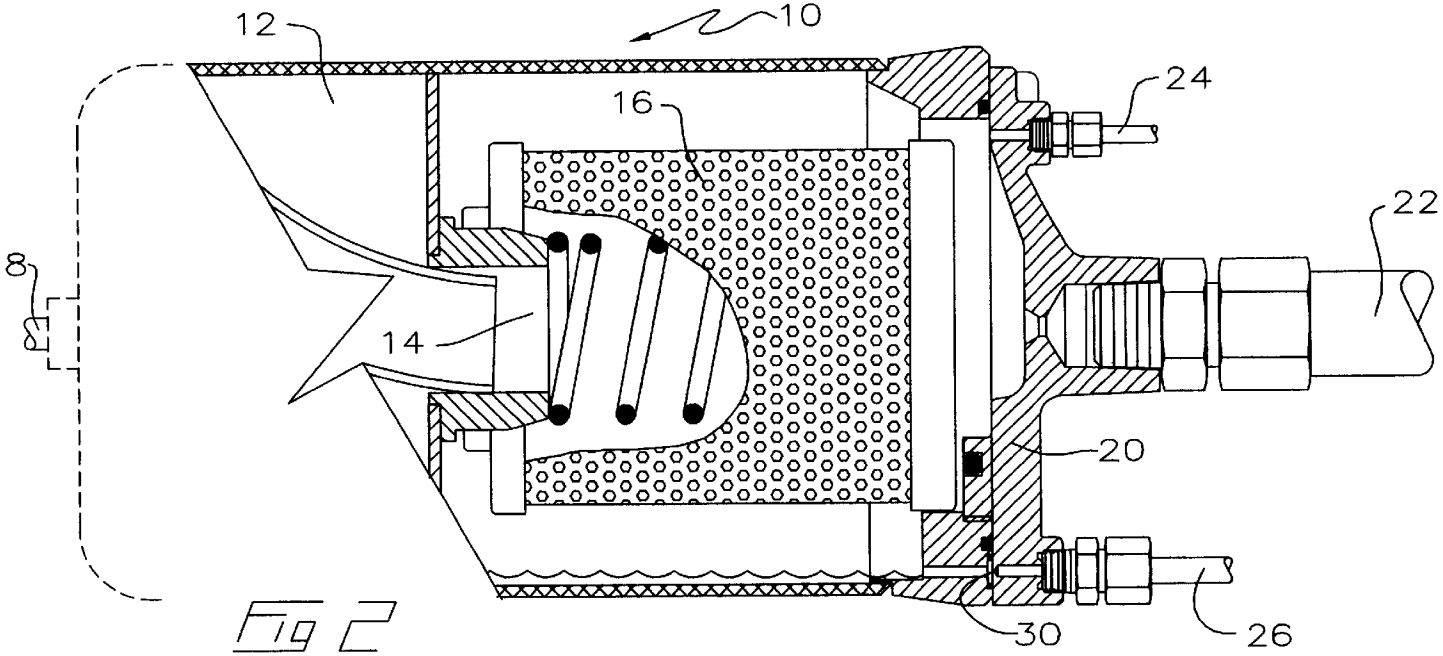
FIG. 2 is a sectional view taken on line 2—2 of FIG. 1.
Figure 2A:
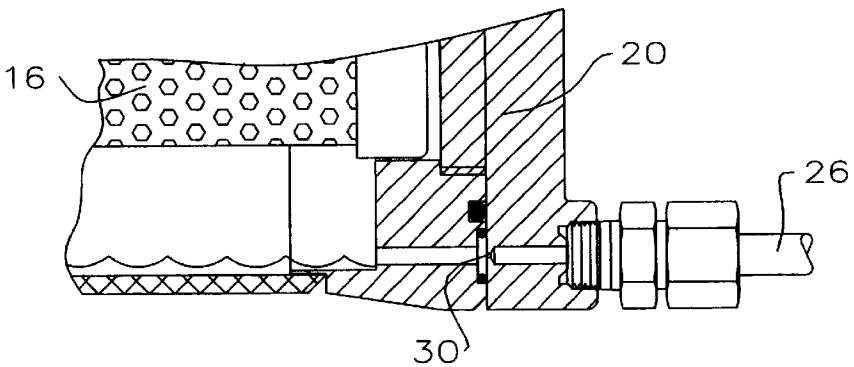
FIG. 2*a* is an enlarged portion of FIG. 2.
Figure 3:
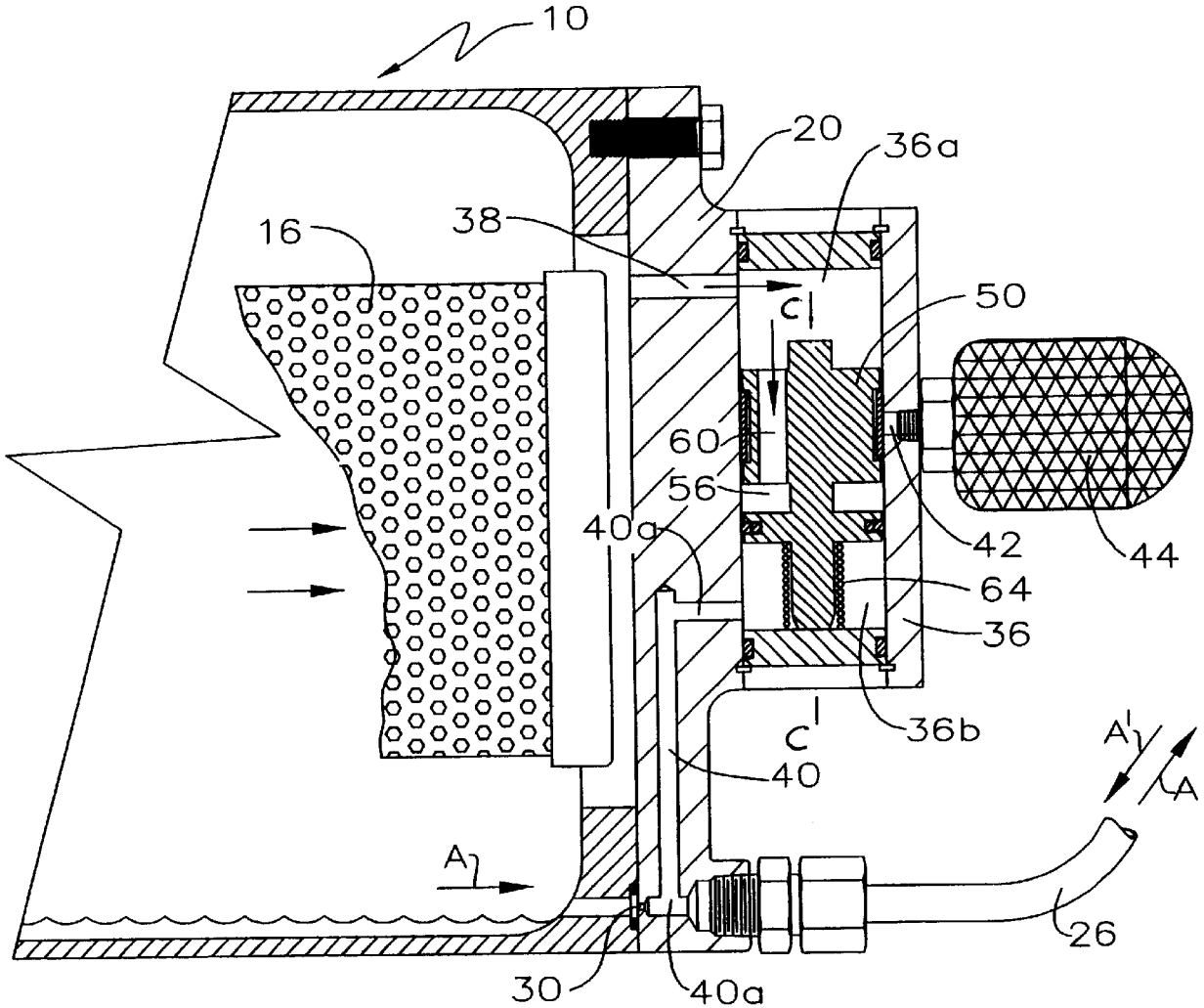
FIG. 3 is a sectional view taken on line 3—3 of FIG. 1 illustrating the valve in the closed position.
Figure 4:
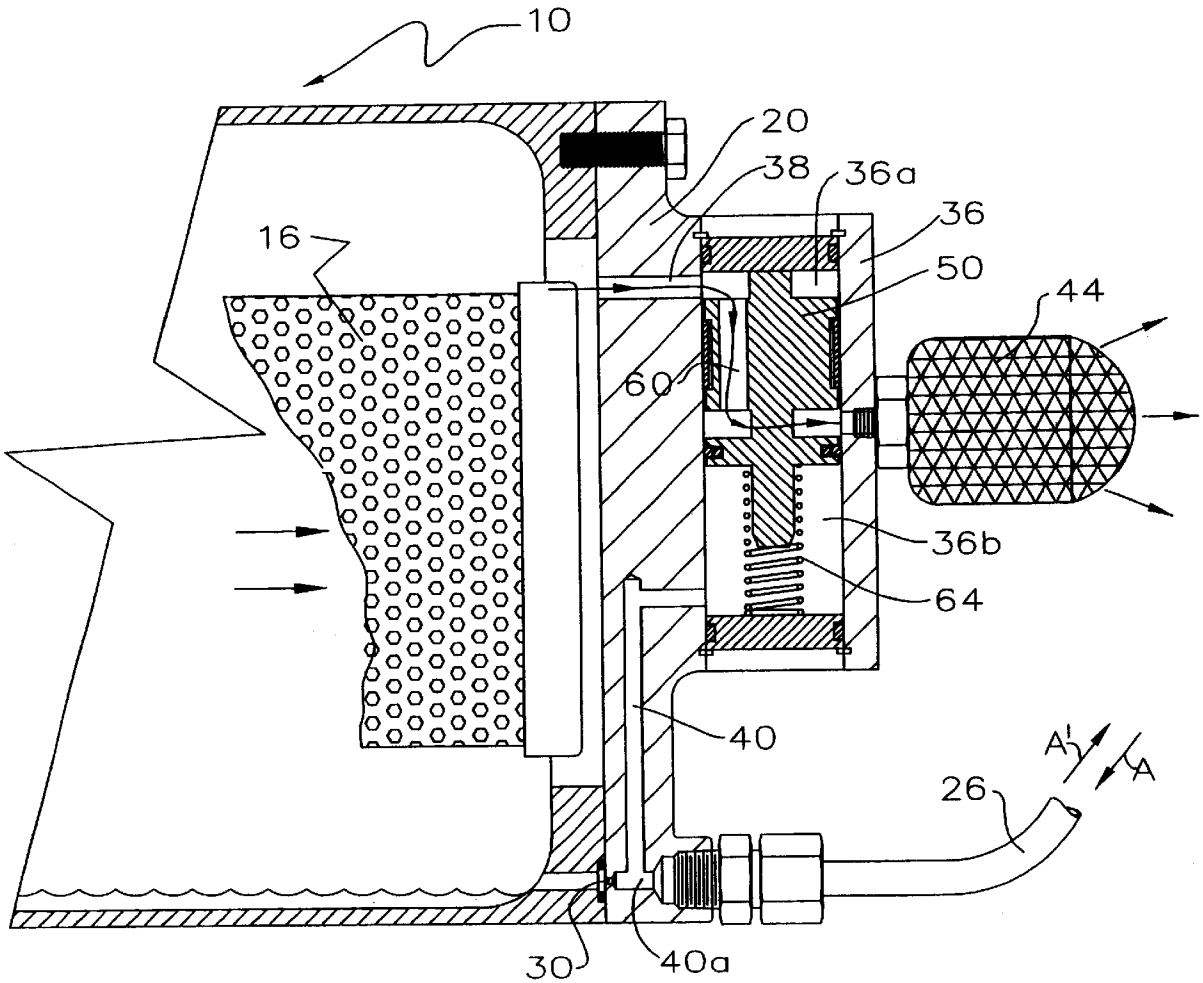
FIG. 4 is a sectional view similar to that illustrated in FIG. 3 with the valve in the open venting position.
Figure 5:
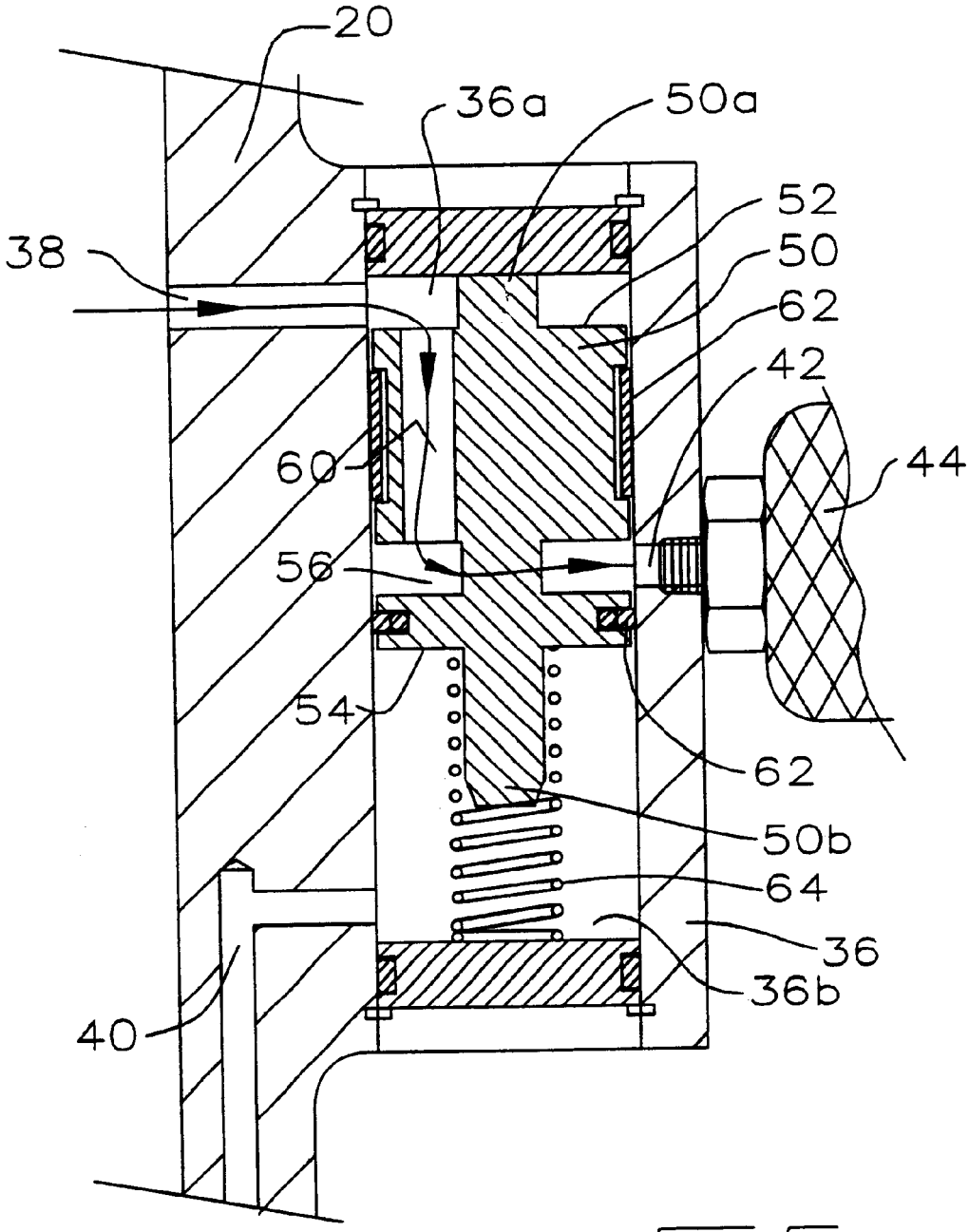
FIG. 5 is an enlarged view of the valve illustrated in FIG. 4.

With reference to the drawing figures, wherein similar characters of reference denote corresponding parts in each view, an air receiving tank 10 has a wet end 12 wherein compressed air saturated with oil undergoes a first stage separation by cyclonic action. This air/oil mixture is transferred through port 14 into perforated canister 16 where further oil separation occurs through coalescing action and gravity. An end cap 20 secured to the receiving tank 10 has a main compressed air discharge line 22 for supplying compressed air to pneumatically operated equipment of various kinds. End cap 20 also has a system pressure signal line 24, which is in fluid communication with the interior of compressor 5 at the compressor inlet valve 6. Cap 20, as well, has an oil scavenging conduit 26, which, at its distal end is in communication with the suction port 5*a* of compressor 5 and its proximal end communicates with the interior of air receiving tank 10 through a high flow impedance scavenging orifice 30.

A blowdown spool valve is incorporated into a generally cylindrical cavity within housing 36 on end cap 20. The interior cavity of housing 36 has opposite ends 36*a* and 36*b* respectively. End 36*a* of housing 36 is in direct fluid communication with air receiving tank 10 through an unobstructed, that is, a low flow impedance passageway 38. End 36*b* is also in fluid communication with air receiving tank 10 through an unobstructed passageway 40 and a high impedance that is, flow obstructing scavenging orifice 30 located between end 40*a* of second passageway 40 and air receiving tank 10. Orifice 30 is sized to optimally restrict two way flow, in direction A and A' of both air and oil relative to compressor 5 and results in a pressure drop between air receiving tank 10 and end 36*b* of valve housing 36 during operation of the compressor. Passageway 40 and end 36*b* of valve housing 36 are essentially in pressure equilibrium since orifice 30 restricts pressurized air flow from air receiving tank 10. A venting orifice or exhaust aperture 42 is formed through housing 36 to provide for escapement of compressed air from air receiving tank 10. Orifice 42 may be fitted with a muffler 44. Conduit 26 thus performs two functions. Its primary function is not as a signal conduit, but rather is to carry or feedback scavenge oil (which drips from coalescer 16 during periods of significant air delivery out line 22) back to the suction (intake) port of the compressor. Orifice 30 limits excessive loss of compressed air back to the compressor intake along conduit 26. The second function of conduit 26 is as a signal pressure feedback conduit directly influencing the blowdown valve function. Thus conduit serves as a dual function feedback conduit providing feedback of scavenged oil to the compressor suction port 5*a* and providing feedback upon compressor shutdown of a pressure signal to the shuttle valve spool 50 inside housing 36.

A generally cylindrical valve spool 50 is slidably mounted for sliding translation along a shuttle axis C within the cylindrical cavity of valve housing 36. Spool 50 has opposite ends 50*a* and 50*b* respectively. Annular end faces 52 and 54 are formed coaxially with, and spaced from, ends 50*a* and 50*b*. Annular end face 52 is spaced from end 50*a* a distance sufficient to prevent occlusion of low impedance passageway 38 when end 50*a* of valve spool 50 is abutted against end 36*a*. An annular channel or recess 56 is formed annularly around valve spool 50, generally parallel to the faces of ends 50*a* and 50*b*. Recess 56 is located in proximity to annular face 54. One or more through passageways 60 are formed longitudinally through first face 52 so as to be in communication with annular recess 56.When end 50*a* of valve spool 50 is at end 36*a*, recess 56 is brought into alignment with venting orifice 42. Valve spool 50 is provided with seals 62 mounted on either side of annular recess 56. A compression spring 64 is mounted over end 50*b* of valve spool 50. Spring 64 rests against and extends between annular face 54 and end 36*b* of housing 36.

When compressor 5 is in operation, compressed air passes from tank 10 through passageway 38 and into end 36*a*. Pressure against annular end face 52 of valve spool 50 results in movement of spool 50 toward end 36*b* of housing 36. In this position, valve spool 50 closes venting orifice 42. Simultaneously, there is a much smaller volume of compressed air passing through high impedance scavenging orifice 30. Air from orifice 30 is removed from end 36*b* and from passageway 40 through air/oil scavenging feedback line 26, which is in communication with the suction inlet port 5*a* of the compressor.

When rotors 5*b* of compressor 5 stop turning, flow of compressed air through high pressure conduit 8 in direction B into air receiving tank 10 ceases. An instantaneous minor backflow of pressurized air from receiving tank 10 then passes through conduit 8 in direction B', in a direction opposite to direction B, to bring tank 10, compressor 5 and suction port 5*a* into pressure equilibrium. The inlet control valve 6 of compressor 5 closes to prevent loss of air/oil through compressor filter 7. Flow across high impedance scavenging orifice 30 also immediately ceases. The low pressure condition at end 36*b* of blowdown valve housing 36 is eliminated as flow of air and oil returns through conduit 26 in direction A', through passageway 40, passage 40*a* and into end 36*b* of valve housing 36, thus equalizing the pressure on both ends 52 and 54 of valve spool 50 to static equilibrium tank/system pressure. Compression spring 64 then urges valve spool 50 toward end 36*a* of valve housing 36 whereby annular recess 56 is brought into communication with venting orifice 42. Compressed air is then vented through passageways 38 and 60 and through annular recess 56 and out to ambient atmosphere through vent orifice 42 and muffler 44 to lower the tank/system pressure, thus avoiding re-start of the compressor under load.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pressure blowdown system for an oil-injected rotary screw air compressor having an output conduit mounted to a high pressure side of the compressor and having a feedback conduit mounted to an intake side of the compressor, the system comprising:

a rigid container having a gas reservoir therein, said container having a rigid plate mounted thereon closing said reservoir, a rigid valve housing mounted to said plate, said housing defining a valve spool cavity, said cavity having first and second opposite ends, a valve spool slidably snugly mounted in said cavity for sliding translation between said first and second ends of said cavity, respectively into first and second positions in said cavity, resilient means mounted in said cavity for resiliently urging said valve spool from said first end towards said second end of said cavity, a first gas passageway in said plate in unobstructed fluid communication between said first end of said cavity and the feedback conduit of the compressor, a second gas passageway in said plate in unobstructed fluid communication between said second end of said cavity and said gas reservoir, said gas reservoir in unobstructed fluid communication with the output conduit of the compressor, said housing having an exhaust aperture into said cavity so that said cavity is in fluid communication with ambient atmosphere when said exhaust aperture is not closed by said valve spool, said exhaust aperture positioned so as to be covered by said spool when translated into said first position in said cavity, said spool having a third gas passageway therethrough in fluid communication from said second end of said cavity to said exhaust aperture when said spool is in said second position, said spool when not in said second position sealing said exhaust aperture closed.

2. The pressure blowdown system of claim 1 further comprising a fourth gas passageway in fluid communication between said gas reservoir and said first gas passageway wherein said fourth gas passageway contains a flow restricting orifice therein restricting fluid flow between said gas reservoir and said first gas passageway.

3. The pressure blowdown system of claim 2 wherein a second end-exposed face of said spool facing said second end of said cavity includes a spacing protrusion extending therefrom along a shuttle axis of said spool for spacing said second end-exposed face from an end wall of said second end of said cavity when said spool is in said second position.

4. The pressure blowdown system of claim 3 wherein said valve spool and said cavity are cylindrical and wherein said second gas passageway includes an annular channel formed around said spool and a bore extending from a second end-exposed face of said spool to said annular channel, wherein said annular channel extends annularly around a shuttle axis of said spool and aligns with said exhaust aperture when said spool is in said second position.

5. The pressure blowdown system of claim 4 wherein said resilient means is a helical spring, and wherein a first end-exposed face of said spool opposite said second end-exposed face includes a bayonet mount mounted thereto aligned along said shuttle axis, said spring mounted onto said bayonet mount.

6. The pressure blowdown system of claim 1 wherein said plate is an end cap on said container.

7. The pressure blowdown system of claim 1 further including a fifth gas passageway in said plate in fluid communication between said gas reservoir and a pressure signal line extending between an inlet valve of the compressor and said fifth gas passageway.

8. The pressure blowdown system of claim 2 wherein said fourth gas passageway is located at the bottom of said gas reservoir and wherein said first gas passageway intersects said fourth gas passageway at the bottom of the gas reservoir and the feedback conduit is mounted to said first gas passageway at the bottom of the gas reservoir.

9. The pressure blowdown system of claim 8 wherein said plate is mounted to said container so as to extend between a bottom of said container adjacent said bottom of said gas reservoir and a top of said container, and wherein said second gas passageway is located adjacent a top of said gas reservoir.

* * * * *